US006741716B2

(12) United States Patent
Morales et al.

(10) Patent No.: US 6,741,716 B2
(45) Date of Patent: May 25, 2004

(54) AFFIXED BEHIND-THE-EAR CHILD RESISTANT VOLUME CONTROL COVER

(75) Inventors: Nelson Morales, Lakeville, MN (US); Kyle Ayen, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 54 days.

(21) Appl. No.: 10/078,652

(22) Filed: Feb. 19, 2002

(65) Prior Publication Data

US 2003/0156726 A1 Aug. 21, 2003

(51) Int. Cl.[7] ..... H04R 25/00
(52) U.S. Cl. ..... 381/330; 381/189
(58) Field of Search ..... 381/322, 323, 381/329, 312, 315, 324, 330, 189, 325, 327, 109, 381; 600/25; 60/56, 57

(56) References Cited

U.S. PATENT DOCUMENTS

| | | | | |
|---|---|---|---|---|
| 3,890,474 A | * | 6/1975 | Glicksberg | 381/72 |
| 4,471,490 A | | 9/1984 | Bellafiore | 381/69 |
| 4,628,907 A | * | 12/1986 | Epley | |
| 4,803,853 A | | 2/1989 | Hoerkens | 63/14.1 |
| 4,840,249 A | * | 6/1989 | Birkholz et al. | 180/129 |
| 5,062,138 A | | 10/1991 | Schmid | 381/68.7 |
| 5,249,234 A | | 9/1993 | Butler | 381/69 |
| 5,533,130 A | | 7/1996 | Staton | 381/68.5 |
| 5,781,637 A | | 7/1998 | Heide et al. | 381/68.6 |
| 6,105,713 A | | 8/2000 | Brimhall et al. | 181/135 |
| 6,249,256 B1 | | 6/2001 | Luxon et al. | 343/702 |
| 6,393,130 B1 | | 5/2002 | Stonikas et al. | 381/322 |
| 6,503,960 B1 | | 1/2003 | Kadziela et al. | 522/78 |
| 6,522,764 B1 | | 2/2003 | Bogeskov-Jensen | 381/330 |
| 6,529,609 B1 | | 3/2003 | Neilson | 381/329 |
| 6,546,107 B1 | | 4/2003 | Bohnke | 381/189 |
| 6,546,109 B1 | | 4/2003 | Gnecco et al. | 381/322 |
| 6,546,110 B1 | | 4/2003 | Vonlanthen | 381/330 |
| 6,549,634 B1 | | 4/2003 | Vonlanthen | 381/322 |
| 6,574,343 B1 | | 6/2003 | Meier | 381/322 |

OTHER PUBLICATIONS

"The Hearing Aid Sweatband", *The Hearing Review, vol 10. No. 4,* (Apr. 4, 2003),p. 79.

* cited by examiner

*Primary Examiner*—Sinh Tran
(74) *Attorney, Agent, or Firm*—Schwegman, Lundberg, Woessner & Kluth, P.A.

(57) ABSTRACT

A control cover for a hearing aid is shown that prevents accidental changes in adjustment. The configurations of openings in the shield portion of the novel control cover substantially prohibit access of a typical human finger from an external side of a shield portion to an internal side of the shield portion. At the same time, the control cover shown allows a tool to access the internal side of the shield portion with the control cover in place. One embodiment of the control cover includes an attachment device that is only installed once, and does not need to be removed for adjustments to the variable control. The attachment device of the control cover will therefore not wear, and will not loosen over time. One embodiment further integrates the control cover with the hearing aid body, thus completely eliminating a possible detachment and loss of the control cover.

26 Claims, 3 Drawing Sheets

AFFIXED BEHIND-THE-EAR CHILD RESISTANT VOLUME CONTROL COVER

FIELD OF THE INVENTION

The invention relates to protective covers. Specifically the invention relates to protective covers of adjustment devices of hearing aids.

BACKGROUND OF THE INVENTION

Devices that amplify sound or in other ways aid in the hearing process are used by ever increasing numbers of people. These devices, or hearing aids, typically include a control for an adjustable variable such as a volume level. A volume adjustment can be used to adjust a level of amplification to match each individual user with their unique hearing needs. One common configuration of hearing aid is designed with a volume control dial located on an external surface of the hearing aid.

External controls for variables such as volume are desirable because they allow adjustment by the end user. If adjustment of the variable such as volume is needed, it is convenient to allow the user to adjust the variable personally, without having to consult a technician. In some day to day situations, it is desirable to change a variable from one setting to another. For example, in a situation with loud background noise, the volume may be lowered temporarily to a more comfortable level, then returned to its previous setting later.

A problem with external controls arises with users such as children, or other users who may frequently bump the external controls and change the settings accidentally. An accidental adjustment of volume causes the hearing aid to be ineffective if the volume is bumped to a setting that is too low, or if the accidental setting is too high, the amplification may be painful or even cause damage to the user. One solution to this problem has been to sell an optional cover that encloses the variable control after it has been adjusted to the desired setting. These covers are frequently made from injection molded plastic, and are fastened with a device such as a snap in place fitting.

Several problems arise with this configuration of a variable control cover. It is cumbersome to adjust the variable control if the cover must be unsnapped from the hearing aid every time it is adjusted. Also, after a number of adjustments, an attachment fitting such as a snap or barb fitting begins to wear. The fitting may break off after a number of uses, requiring the user to purchase another, or it may loosen, and fail to adequately fasten after a number of uses. In this case, the variable control cover may fall off and become lost. This is especially dangerous in the case of a child user because the variable control cover may present a choking hazard if separated from the hearing aid.

What is needed is a variable control cover that may be fastened to a hearing aid, that prevents accidental changes in settings. What is also needed is a variable control cover that is easier for a guardian of a child or other end user to adjust. What is also needed is a variable control cover that does not wear over time from frequent removals and installations for adjustment.

SUMMARY OF THE INVENTION

The invention shows a control cover including a shield adapted for optional coupling to a hearing aid, the shield having a first side, and a second side. The control cover also includes an opening within the shield, the opening being dimensioned to substantially prohibit a human finger located adjacent to the first side from accessing a location adjacent to the second side wherein the opening is dimensioned to allow a tool located adjacent to the first side to access the location adjacent to the second side.

The opening may be partially open on a lateral side of the shield in one embodiment. The opening may be dimensioned with a smaller cross sectional area than a distal end of a typical human finger. The tool may be dimensioned with a distal end having a cross section smaller than a typical human finger.

Also shown is a hearing aid assembly that includes an amplifier circuit and an adjustable variable control. A control cover is included in the hearing aid assembly coupled adjacent to the adjustable variable control. The control cover includes a shield, having a first side, and a second side. The control cover also includes an opening within the shield, the opening being dimensioned to substantially prohibit a human finger located adjacent to the first side from accessing the adjustable variable control located adjacent to the second side wherein the opening is dimensioned to allow a tool located adjacent to the first side to access the adjustable variable control located adjacent to the second side. The variable control may include a volume control. In one embodiment, the control cover may be integrally formed with a hearing aid body.

Also shown is a method for manufacturing a control cover. The method includes forming a shield adapted for optional coupling to a hearing aid, the shield having a first side and a second side. The method further includes shaping an opening within the shield, the opening substantially prohibiting a human finger located adjacent to the first side from accessing a location adjacent to the second side. The method also includes shaping the opening to allow a tool located adjacent to the first side to access the location adjacent to the second side.

DETAILED DESCRIPTION OF THE PREFERRED EMBODIMENTS

Figure 1A:
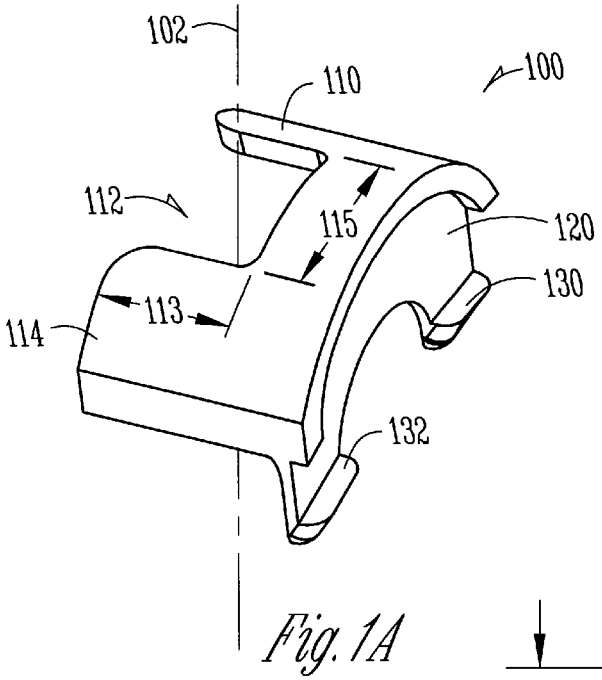
FIG. 1A shows an isometric view of a control cover according to an embodiment of the invention.

In the following detailed description of the invention, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention.

In the following detailed description, references to directions such as up, down, top or bottom will generally refer to an orientation of a hearing aid when in place on a user. The upward direction is towards the user's head, and the downward direction is towards the user's feet, etc. References to outside surfaces will generally refer to a side of a component that is accessible to the user, or can be seen by the user in normal operation. Likewise, references to inside surfaces will generally refer to a side of a component that is normally concealed from the user.

FIG. 1A shows one embodiment of a control cover 100. The control cover includes a shield portion 110 with an opening 112 in the shield portion 110. In one embodiment, the shield portion 110 is arc shaped, however other shapes are included within the scope of the invention. The shield portion 110 in one embodiment is adapted to fit closely adjacent to a variable control of a hearing aid the specific shape and location of the shield portion will depend on the shape and location of the variable control that the shield is adapted to be used with. The opening 112 in the shield portion 110 has an associated cross sectional area that in one embodiment is roughly defined by multiplying a length 115 of the opening 112 by a width 113 of the opening. As is shown in FIG. 1A, one configuration of the opening 112 is generally rectangular.

Figure 1B:
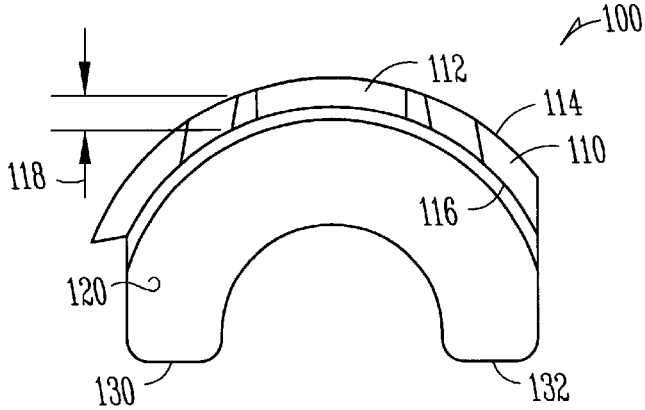
FIG. 1B shows a plan view of a side of a control cover according to an embodiment of the invention.
Figure 1C:
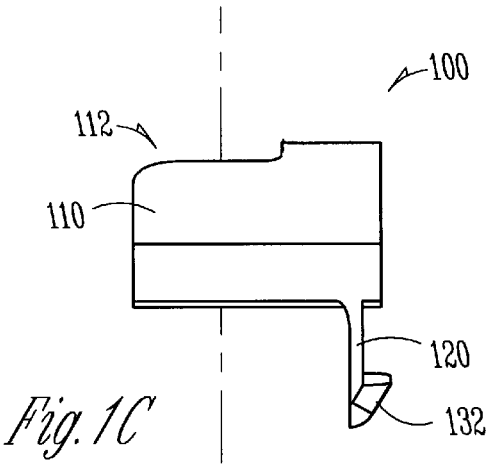
FIG. 1C shows a plan view of another side of a control cover according to an embodiment of the invention.

FIG. 1B shows the control cover 100 from a side view. In this view, an external side 114 of the shield portion 110 is shown along with an internal side 116 of the shield portion 110. The shield portion 110 shown, also includes a shield thickness 118.

Figure 1D:
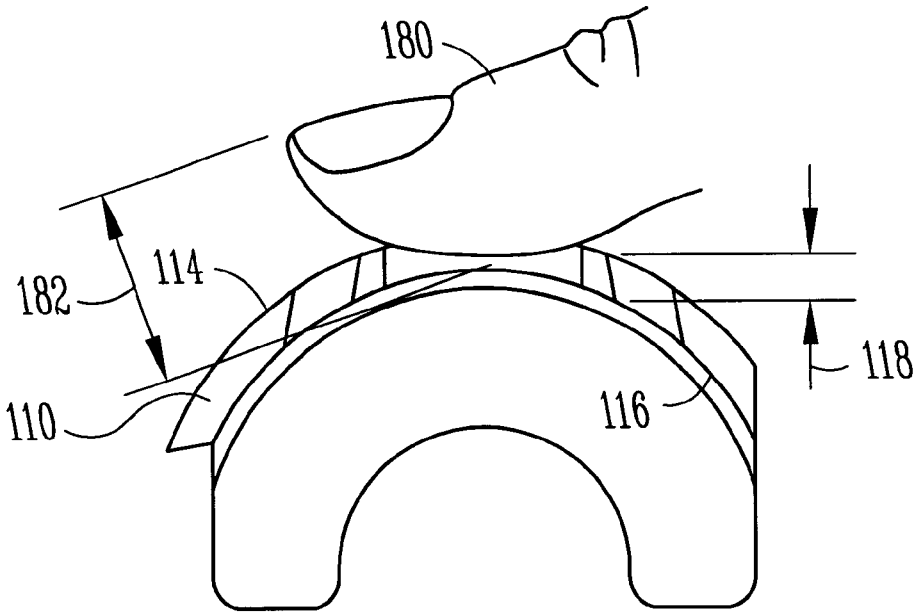
FIG. 1D shows a plan view of a control cover according to the invention and a typical human finger.

As shown in FIG. 1D, the dimensions of the opening 112 are made such that a typical human finger 180 located on the external side 114 of the shield portion 110 is substantially prohibited from accessing the internal side 116 of the shield portion 110. In one embodiment, a typical human finger 180 may be able to penetrate a portion of the shield thickness 118, but the dimensions, such as cross section dimension 182, of the typical human finger 180 will substantially prohibit access of the finger to any object or location adjacent to the internal side 116 of the shield portion.

Figure 1E:
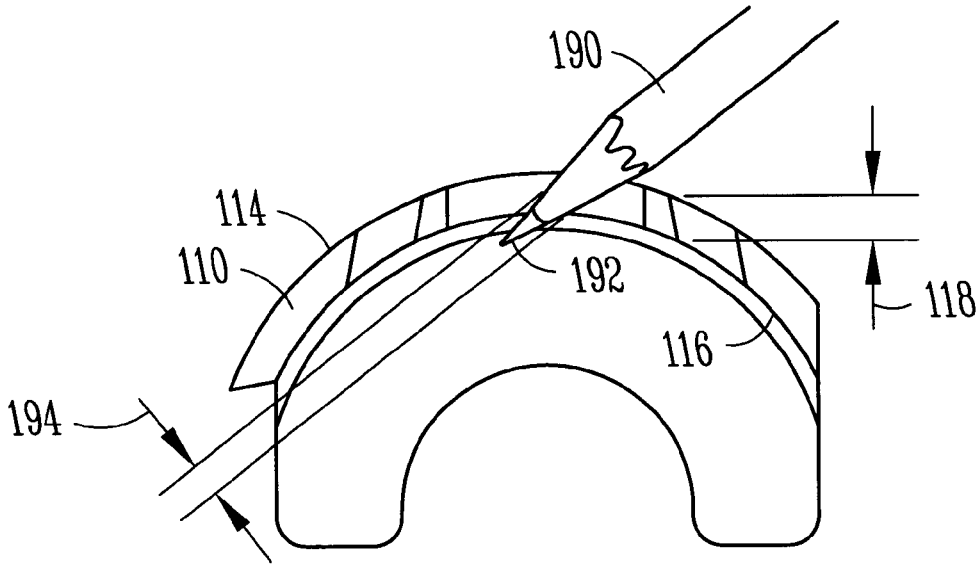
FIG. 1E shows a plan view of a control cover according to the invention and a tool for use with the invention.

At the same time, as shown in FIG. 1E, the opening 112 is dimensioned such that a specially configured tool 190 located on the external side 114 of the shield portion 110 is capable of accessing the internal side 116 of the shield portion 110 through the shield thickness 118. In one embodiment, a distal end of the tool 192 includes a smaller section dimension 194 than the cross section dimension 182 of the typical human finger 180. The smaller cross section dimension 194 of the distal end 192 of the tool allows the tool 190 access to the internal side 116 of the shield portion 110 while at the same time a typical human finger 180 is unable to access the internal side. In one embodiment of the invention, appropriate tools would include a paper clip, or a pencil tip, etc. One skilled in the art, with the benefit of having read the present specification, will appreciate that numerous varieties of tools can be used within the scope of the invention and the specific examples in the drawings and detailed description should be taken as examples only, without limitation to the larger category of appropriate tools.

One skilled in the art, with the benefit of having read the present specification, will recognize that other shapes of openings 112 can be used without departing from the scope of the invention. Openings 112 may be dimensioned to include circles, ellipses, slots, other more complex shapes, or portions thereof. Alternatively dimensioned openings 112 will have associated cross sectional areas defined generally as a roughly planar open area that is normal to an opening axis 102 as shown in FIG. 1A. In one embodiment, the opening 112 is not fully enclosed on all lateral sides, however this is not a requirement. Other openings are contemplated within the scope of the invention that are laterally enclosed by the shield portion 110 on all directions laterally radiating from the opening axis 102.

In one embodiment, the size of the cross sectional area of the opening 112 alone is used to substantially prohibit access from a human finger 180, while still allowing access from a tool 190. Other embodiments utilize a geometry of the opening 112 alone, or in combination with a cross sectional dimension to substantially prohibit access from a human finger 180, while still allowing access from a tool 190.

A typical human finger 180 has a cross section that is substantially round. If, for example, a thin slot were utilized for the opening 112, the slot may have a numerical cross sectional area that is larger than a finger's cross sectional area, however due to the typical human finger's round cross section geometry, a width of the opening 112, or other dimension that is thinner than a diameter of the finger 180 would still be effective to prohibit access of the finger 180 and to allow access of the tool 190.

Likewise, the tool 190 in one embodiment uses a smaller cross sectional dimension 194 at a distal end 192 to facilitate access through the opening 112. In other embodiments, a geometry of the distal end 192 of the tool is utilized either alone or in combination with the cross sectional area to facilitate selected access through the opening 112.

The control cover 100 shown in FIGS. 1A–1E also includes a side portion 120 which couples the shield portion 110 to a first attachment device 130 and a second attachment device 132. Although a pair of attachment devices are shown in FIG. 1A, other embodiments containing a single attachment device may also be used. Further, more that two attachment devices are also possible within the scope of the invention. The attachment devices may include tabs suitable for mating with slots, or barbs or other suitable mechanical attachment devices. Additionally, either the first or second or both attachment devices 130, 132 may merely include a surface for bonding. Methods such as adhesives, or ultrasonic welding, etc. may be used in a bonding configuration.

Figure 2:
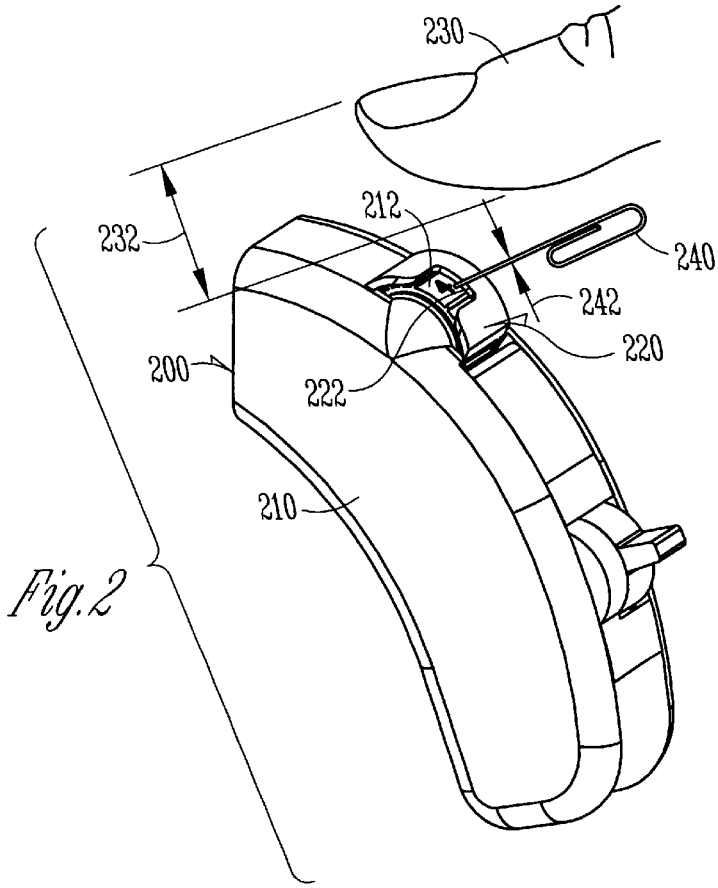
FIG. 2 shows an isometric view of a hearing aid assembly according to an embodiment of the invention.

FIG. 2 shows a hearing aid assembly 200. The hearing aid assembly includes a hearing aid body 210 which houses a standard amplification circuit (not shown). One skilled in the art, with the benefit of having read the present specification, will understand construction and utilization of a typical amplification circuit. Also included in the hearing aid assembly 200 is a variable control 212. In one embodiment the variable control 212 includes a volume control. Other possible variable controls 212 may include, but are not limited to, power switches, or acoustic wave length tuning controls.

In one embodiment, the variable control 212 is in the form of a dial, and is located substantially on the top of the hearing aid body 210. One skilled in the art, with the benefit of having read the present specification, will appreciate that the location of the variable control can be varied to locations such as a side or back of the hearing aid without departing from the scope of the invention.

A control cover 220 is also included in the hearing aid assembly 200 shown in FIG. 2. The control cover 220 is coupled to the hearing aid body adjacent to the variable control 212 in such a way as to shield a portion of the variable control 212. The control cover 220 includes an opening 222 that allows limited access to the variable control 212.

Similar to the embodiments discussed above, the opening 222 in the control cover 220 is dimensioned to substantially prohibit a typical human finger 230 from accessing the variable control 212. In one embodiment, a cross sectional dimension 232 of the human finger 230 is larger than the opening 222. At the same time, a tool 240 with a cross sectional dimension 242 is able to access the variable control 212 due to the smaller cross sectional dimension 242 of the tool 240 compared to the cross sectional dimension 232 of the finger 230. As discussed above, geometry of the opening 222 and the tool 240 may also be used either alone, or in combination with cross sectional area, to substantially prohibit access of the finger 230 and to allow access of the tool 240.

Figure 3:
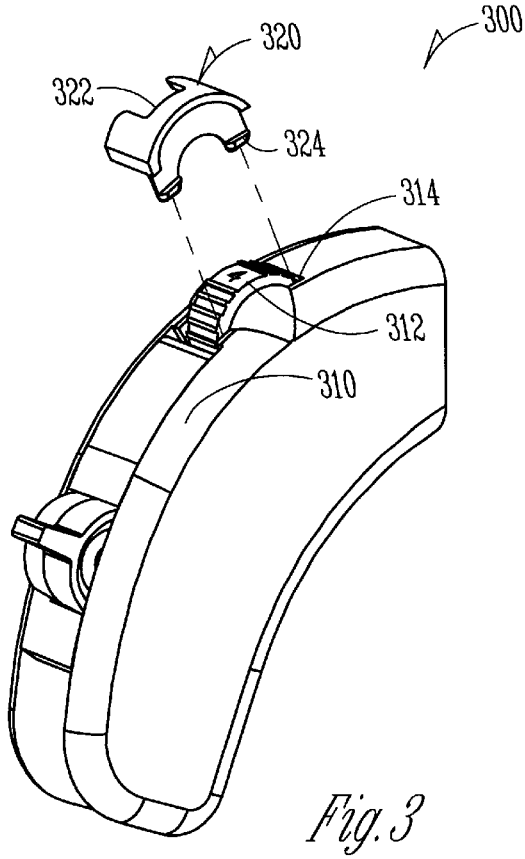
FIG. 3 shows a top view of a hearing aid assembly according to an embodiment of the invention.

FIG. 3 shows a hearing aid assembly 300, including a hearing aid body 310, a variable control 312 and a control cover 320. In one embodiment, the control cover 320 is manufactured as a separate component from the hearing aid body 310. In FIG. 3, the control cover 320 is coupled to the hearing aid body using an attachment device 324 such as a tab. The attachment device 324 is mated with a mating device 314, such as a slot, in the hearing aid body 310. In one embodiment the attachment device 324, or tab, is deformed and pressed into the mating device 314, or slot. One skilled in the art, with the benefit of having read the present specification, will appreciate that other forms of attachment devices 324 and mating devices 314 can be used without departing from the scope of the invention.

The attachment device 324 and mating device 314 shown in FIG. 3 are essentially mechanical devices. In other embodiments, the attachment devices 324 includes a first mating surface adapted for bonding. The mating device 314 in one embodiment includes a second mating surface for bonding. Other methods of attachment could also include, but are not limited to thermal or ultrasonic welding.

In addition to the embodiments discussed above, the control cover may be integrally molded with the hearing aid body 310 and not require attachment at all. There are advantages and drawbacks to both detachable control cover 320 designs and integrally molded designs. With an integral molded design, a separate mold for manufacturing is not required, and an assembly step is eliminated in the manufacturing process. However, in the detachable design, there is greater product flexibility in that one model of hearing aid bodies 310 can be used for both standard hearing aids, and hearing aids that require a control cover. The detachable approach therefore also saves money in the manufacturing process by eliminating the need for a separate product mold for hearing aid bodies 310 with an integral control cover, and hearing aid bodies without an integral control cover. Both the integrally molded design and the detachable design of the present invention incorporate novel design features that solve the problems presented by current configurations.

CONCLUSION

Thus has been shown a control cover that prevents accidental changes in adjustment. The configurations of openings in the shield portion of the novel control cover substantially prohibit access of a typical human finger from an external side of the shield portion to an internal side of the shield portion. When the control cover is located adjacent to a variable control on a hearing aid, such as a volume control, a typical human finger is substantially prohibited from accessing the variable control.

Also shown is a control cover that is easier for a guardian or other end user to adjust. Because a tool may still access the internal side of the shield portion with the control cover in place, the guardian is no longer required to remove the control cover before adjusting the variable control. This saves a step, and is easier and less time consuming than the process required in current configurations.

Also shown is a control cover with an attachment device that does not wear over time. The novel control cover shown is only installed once, and does not need to be removed for adjustments to the variable control. The attachment device of the control cover will therefore not wear, and will not loosen over time. This reduces or eliminates possible loss or breakage of the control cover. One embodiment further integrates the control cover with the hearing aid body, thus completely eliminating a possible detachment and loss of the control cover.

Although specific embodiments have been illustrated and described herein, it will be appreciated by those of ordinary skill in the art, with the benefit of having read the present specification, that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A control cover, comprising:

a shield adapted for optional coupling to a hearing aid, the shield having a first side, and a second side wherein the second side is adapted for placement adjacent to an adjustable variable control;

an opening within the shield, the opening being dimensioned to substantially prohibit a human finger located adjacent to the first side from accessing a location adjacent to the second side; and wherein the opening is dimensioned to allow a tool located adjacent to the first side to physically access the location adjacent to the second side.

2. The control cover of claim 1, wherein the opening is partially open on a lateral side of the shield.

3. The control cover of claim 1, wherein the opening is dimensioned to allow a distal end of the tool located adjacent to the first side to access the location adjacent to the second side, the distal end of the tool being smaller than a distal end of a human finger.

4. The control cover of claim 1, wherein the opening is dimensioned with a cross sectional area that is smaller than a cross sectional area of a human finger.

5. The control cover of claim 1, wherein the opening is dimensioned with a geometric shape that substantially prohibits a human finger located adjacent to the first side from accessing a location adjacent to the second side.

6. The control cover of claim 1, further including an attachment device coupled to the shield.

7. The control cover of claim 6, wherein the attachment device is integrally formed with the shield.

8. The control cover of claim 6, wherein the attachment device includes a tab.

9. A hearing aid, comprising:

an amplifier circuit;

an adjustable variable control;

a control cover coupled adjacent to the adjustable variable control, including:

a shield, having a first side, and a second side;

an opening within the shield, the opening being dimensioned to substantially prohibit a human finger located adjacent to the first side from accessing the adjustable variable control located adjacent to the second side; and wherein the opening is dimensioned to allow a tool located adjacent to the first side to physically access the adjustable variable control located adjacent to the second side.

10. The hearing aid of claim 9, wherein the adjustable variable control includes a volume control.

11. The hearing aid of claim 9, wherein the opening is dimensioned to allow a distal end of the tool located adjacent to the first side to access the location adjacent to the second side, the distal end of the tool being smaller than a distal end of a human finger.

12. The hearing aid of claim 9, wherein the opening is dimensioned with a cross sectional area that is smaller than a cross sectional area of a human finger.

13. The hearing aid of claim 9, wherein the opening is dimensioned with a geometric shape that substantially prohibits a human finger located adjacent to the first side from accessing a location adjacent to the second side.

14. The hearing aid of claim 9, wherein the control cover is integrally formed with a hearing aid body.

15. The hearing aid of claim 9, wherein the control cover is attached to a hearing aid body using an attachment device.

16. A method of manufacturing a control cover, comprising:

forming a shield adapted for optional coupling to a hearing aid, the shield having a first side and a second side;

shaping an opening within the shield, the opening substantially prohibiting a human finger located adjacent to the first side from accessing a location adjacent to the second side; and shaping the opening to allow a tool located adjacent to the first side to physically access the location adjacent to the second side.

17. The method of claim 16, wherein shaping the opening includes shaping an opening with a cross sectional area that is smaller than a cross sectional area of a human finger.

18. The method of claim 16, wherein shaping the opening includes shaping an opening with a geometric shape that substantially prohibits a human finger located adjacent to the first side from accessing a location adjacent to the second side.

19. The method of claim 16, further including coupling an attachment device to the shield.

20. The method of claim 19, wherein coupling the attachment device to the shield includes integrally forming an attachment device with the shield.

21. The method of claim 19, wherein coupling the attachment device to the shield includes coupling a tab to the shield.

22. A hearing aid, comprising:

an amplifier circuit;

a volume control;

a control cover coupled adjacent to the volume control, including:

a shield, having a first side, and a second side;

an opening within the shield, the opening being dimensioned to substantially prohibit a human finger located adjacent to the first side from accessing the volume control located adjacent to the second side; and wherein the opening is dimensioned to allow a tool located adjacent to the first side to physically access the volume control located adjacent to the second side.

23. The hearing aid of claim 22, wherein the control cover is integrally formed with a hearing aid body.

24. The hearing aid of claim 22, wherein the control cover is attached to a hearing aid body using an attachment device.

25. The hearing aid of claim 22, wherein the opening is dimensioned with a cross sectional area that is smaller than a cross sectional area of a human finger.

26. The hearing aid of claim 22, wherein the opening is dimensioned with a geometric shape that substantially prohibits a human finger located adjacent to the first side from accessing the volume control.

* * * * *

UNITED STATES PATENT AND TRADEMARK OFFICE

CERTIFICATE OF CORRECTION

PATENT NO. : 6,741,716 B2
DATED : May 25, 2004
INVENTOR(S) : Morales et al.

It is certified that error appears in the above-identified patent and that said Letters Patent is hereby corrected as shown below:

Column 6,
Line 36, delete “optional” before “coupling”.
Line 38, delete “adjacent to” and insert -- over --, therefor.

Column 7,
Line 36, delete “optional” before “coupling”.
Line 45, after “access” insert -- an adjustable variable control at --, therefor.

Signed and Sealed this

Thirty-first Day of August, 2004

JON W. DUDAS
*Director of the United States Patent and Trademark Office*